United States Patent [19]

Paetz

[11] 4,235,063

[45] Nov. 25, 1980

[54] METHOD AND APPARATUS FOR PACKAGING COMPRESSIBLE MATERIAL

[75] Inventor: Frederic H. Paetz, Newark, Ohio

[73] Assignee: Owens-Corning Fiberglas Corporation, Toledo, Ohio

[21] Appl. No.: 974,166

[22] Filed: Dec. 28, 1978

[51] Int. Cl.[3] ..... B65B 5/04

[52] U.S. Cl. ..... 53/436; 53/114; 53/527; 53/258

[58] Field of Search ..... 53/436, 114, 527, 528, 53/258; 100/240

[56] References Cited

U.S. PATENT DOCUMENTS

| | | | |
|---|---|---|---|
| 1,685,566 | 9/1928 | Gail | 53/114 |
| 2,374,147 | 4/1945 | Weeks | 53/527 |
| 2,732,112 | 1/1956 | Conrad | 53/258 |
| 2,957,288 | 10/1960 | Anderson | 53/258 X |
| 4,015,402 | 4/1977 | Domnitz et al. | 53/258 X |

*Primary Examiner*—Travis S. McGehee

*Attorney, Agent, or Firm*—Ronald C. Hudgens; Philip R. Cloutier; Ted C. Gillespie

[57] ABSTRACT

A method and apparatus for packaging flexible duct material comprises positioning the duct material in a guide means, slidably moving a contact means into contact with the duct material to compress it into a carton, partially closing the end of the carton, and removing the contact means from the carton.

5 Claims, 2 Drawing Figures

METHOD AND APPARATUS FOR PACKAGING COMPRESSIBLE MATERIAL

Figures 1, 2:
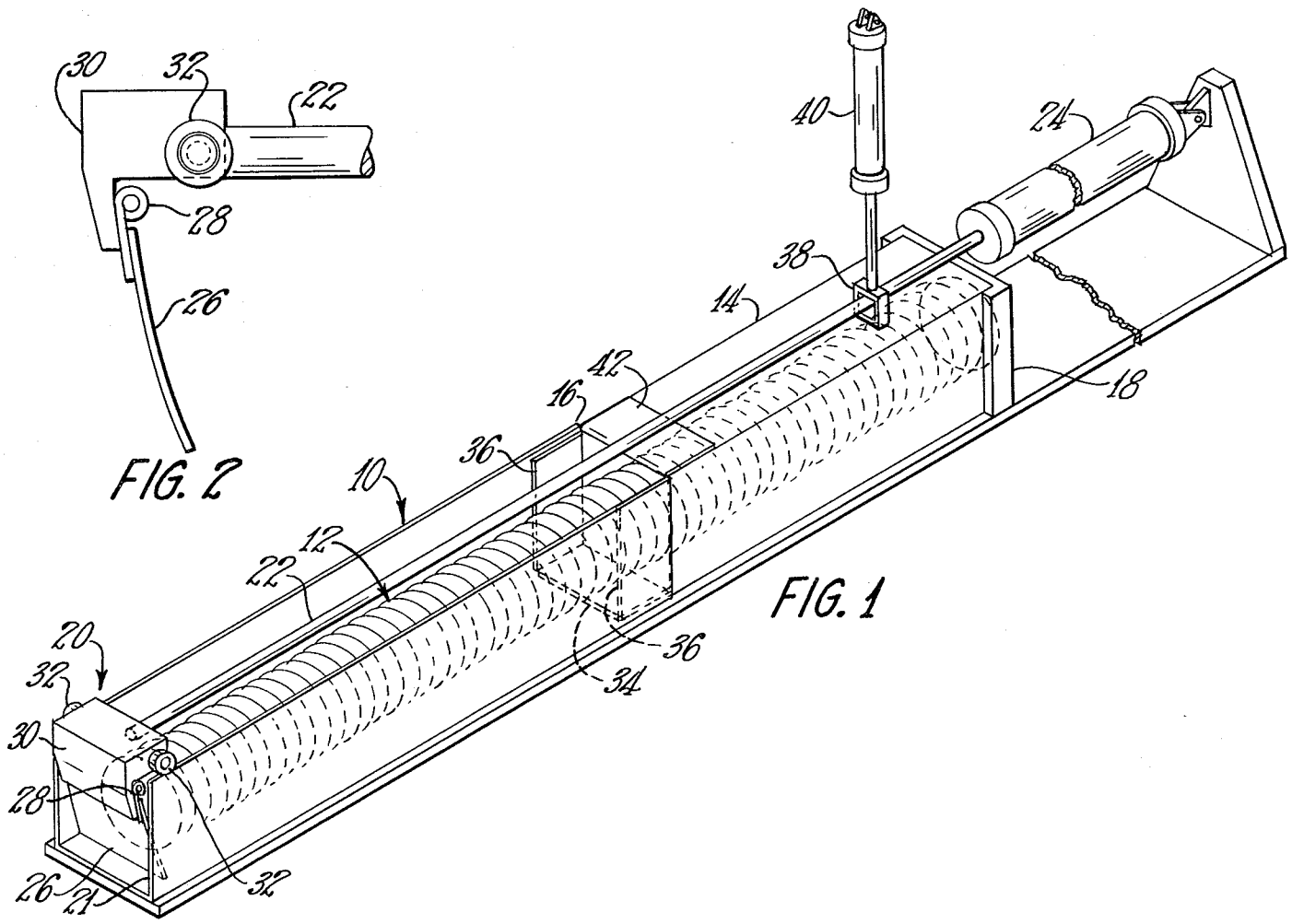

This invention relates to the packaging of compressible material. In one of its more specific aspects, this invention relates to the positioning of compressible material, such as flexible duct material, into apparatus for compressing the flexible duct material, and thereafter compressing the material into a receptacle.

It is common practice in the packaging of compressible material, such as flexible duct material, to position the compressible material within a guide trough, or chute, having an endless belt or conveyor as its bottom surface in order to force the compressible material into a receptacle or package. It is known within the art of packaging compressible material that an additional power-operated conveyor can be positioned above the compressible material to aid in forcing the material into the package. It is also known in the art that the forcing of the compressible material into the package can be aided by means of a vacuum system providing a partial vacuum in the package. Another packaging system known in the art is that of inserting the compressible material into an open end of a tube, placing an open end of a package over the tube so that the package encloses the open end of the tube, and compressing the compressible material with a plunger to eject the compressible material from the tube into the package. All of the above packaging systems require either complex apparatus or constant attention by an operator. Also, the packaging systems of the prior art lack efficient means for holding the material in a compressed state during closure of the package.

There has now been developed for packaging compressible material a method and apparatus in which the material is compressed by the force of a contact member into a package or receptacle with a high degree of compression, and in which the compressible material is held in compression during the closure of the package and during the retraction of the contact member. This apparatus and method are particularly suitable for the compression and packaging of flexible duct material.

According to this invention there is provided apparatus for packaging compressible material comprising a guide means for restricting the movement of the compressible material and contact means positionable at a locus along the length of the guide means to compress the compressible material therein, the contact means comprising a retractable member. The contact means can comprise a rod member from which the retractable member depends, the rod member being slidably mounted at the one end of the guide means. The contact means can be positionable to compress the compressible material toward the one end. The guide means can be adapted to restrict the movement of the compressible material to unidimensional movement, and the guide means can comprise a three-sided trough. The contact member can be a plate hinged for bending toward the one end.

Also, according to this invention there is provided a method for packaging compressible material in which the compressible material is positioned in a guide means, a contact means is moved into contact with the compressible material to compress the material into a receptacle, the end of the receptacle is partially closed, thereby partially enclosing the contact means, and the contact means is removed from the receptacle. The removing of the contact means from the receptacle can be by a lifting of the contact means. The end of the receptacle can be closed after the contact means is removed.

This invention will be more fully understood by reference to the drawings in which FIG. 1 illustrates the apparatus for packaging compressible material according to the principles of the invention, and in which FIG. 2 is a partial sectional view of the contact means of the apparatus of FIG. 1.

Referring to FIGS. 1 and 2, there is shown guide means 10 into which compressible material, such as flexible duct material 12, is positioned. The purpose of the guide means is to restrict the movement of the compressible material to unidimensional movement during compression. The guide means is shown as being a three-sided trough, but it is to be understood that the principles of this invention can be followed utilizing alternate guide, or restriction, means designs, such as using guide rails to restrict the movement of the duct material to unidimensional movement. Receptacle, or carton 14, can be positioned at one end, or first end 16, of the guide means for the receipt of the duct material. Carton stop plate 18 can be positioned to prevent the sliding of the carton during the compression of the duct material.

Contact means 20 can be mounted at the first end of the guide means and can be movable from second end 21 of the guide means to the first end of the guide means to compress the duct material. The contact means can comprise rod member, or pull rod 22, which is slidably mounted at the first end of the guide means. The movement of the pull rod can be effected by the operation of hydraulic means 24. The pull rod prevents the duct material from springing out of the guide means during compression, and, therefore, facilitates unidimensional movement of the duct material.

The contact means also comprises contact plate 26, which is a retractable member, "retractable" being defined as having that quality which enables the member to be withdrawn from a partially closed carton. In the peferred embodiment, the contact plate comprises a thin plate which is smaller in width than the width of the carton. In a less preferred embodiment of the invention, the contact plate comprises a plurality of substantially vertical rods, which are retractable members. The contact plate can be hingeably mounted from the pull rod for bending towards the first end of the guide means. As shown in FIG. 2, the contact plate can be swung about hinge 28 towards the first end of the guide means, but is restricted from bending away from the first end of the guide means by stop plate 30. The contact means can be mounted on wheels 32 adapted for travel along the sides of the guide means to facilitate the positioning of the contact means along the length of the guide means during the compression of the duct material.

During the packaging of the duct material, the contact plate moves slidably into contact with the duct material to compress it into the carton. Once the compressible material is entirely within the carton, bottom flap 34 and side flaps 36 can be closed and secured to partially close the end of the carton, and thereby partially enclose the contact plate. Subsequently, the contact plate is removed, or retracted, from the carton, and the bottom flap and side flaps of the carton maintain the compression on the duct material. The pull rod can be adapted with rod lifter bracket 38 and hydraulic means 40 to permit the lifting of the rod lifter bracket and, consequently, the pull rod and contact plate to remove the contact plate from the carton. Subsequent to the removal of the contact plate from the carton, top flap 42 can be folded down to completely close the end of the receptacle. The fact that the contact plate is hingeably mounted from the pull rod enables the contact plate to be more easily removed from the partially closed carton.

Various modifications of the above described embodiments of the invention will be apparent to those skilled in the art, and it is to be understood that such modifications can be made without departing from the scope of the invention.

I claim:

1. Apparatus for packaging compressible material in a carton having a bottom flap and side flaps comprising:

(a) a trough-shaped guide means for restricting the movement of the compressible material; and, (b) contact means positionable at a locus along the length of said trough-shaped guide means to compress the compressible material therein, said contact means comprising a rod member slidably mounted at one end of said trough-shaped guide means, and a hinged plate adapted to be withdrawn from said carton after said bottom and side flaps are closed, said trough-shaped guide means and said rod adapted to restrict the movement of the compressible material to unidimentional movement.

2. The method for packaging compressible material comprising:

(a) positioning compressible material in a guide means;

(b) moving a contact means into contact with said compressible material to compress said compressible material into a carton having a bottom flap and side flaps;

(c) closing said bottom and side flaps, thereby partially enclosing said contact means; and, (d) removing said contact means from said carton.

3. The method of claim 2 comprising slidably moving said contact means.

4. The method of claim 3 comprising lifting said contact means from said carton.

5. The method of claim 4 comprising closing the top flap of said carton.

* * * * *